US011561017B2

(12) United States Patent
Kole et al.

(10) Patent No.: US 11,561,017 B2
(45) Date of Patent: Jan. 24, 2023

(54) EXHAUST FAN UNIT OF A HEATING, VENTILATION, AND/OR AIR CONDITIONING (HVAC) SYSTEM

(71) Applicant: Air Distribution Technologies IP, LLC, Milwaukee, WI (US)

(72) Inventors: Anup T. Kole, Dudhgaon (IN); Sethuram Parameswaran, Kochi (IN); Luis L. Vargas, Sachse, TX (US); Juan Kennedy, Plano, TX (US); Parmeshwar G. Patil, Pune (IN)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 132 days.

(21) Appl. No.: 16/836,671

(22) Filed: Mar. 31, 2020

(65) Prior Publication Data

US 2021/0172630 A1 Jun. 10, 2021

Related U.S. Application Data

(60) Provisional application No. 62/945,621, filed on Dec. 9, 2019.

(51) Int. Cl.

| | |
|---|---|
| ***F24F 7/10*** | (2006.01) |
| ***F24F 13/065*** | (2006.01) |
| *F24F 13/22* | (2006.01) |

(52) U.S. Cl.

CPC ..... *F24F 7/10* (2013.01); *F24F 13/065* (2013.01); *F24F 13/222* (2013.01)

(58) Field of Classification Search

CPC ..... F24F 2007/001; F24F 13/26; F24F 1/01; Y10S 416/08

USPC ..... 454/17, 39–40

See application file for complete search history.

(56) References Cited

U.S. PATENT DOCUMENTS

| | | | | |
|---|---|---|---|---|
| 2,188,564 A * | 1/1940 | Berg | F23L 17/02 | 454/39 |
| 2,763,196 A * | 9/1956 | Singleton | F23L 17/02 | 454/36 |
| 4,344,370 A * | 8/1982 | Smith | F23L 17/005 | 110/162 |
| 4,638,632 A * | 1/1987 | Wulf | F01N 13/082 | 110/160 |
| 4,806,076 A | 2/1989 | Andrews | | |
| 5,636,993 A * | 6/1997 | Badry | F24D 5/04 | 454/236 |

(Continued)

FOREIGN PATENT DOCUMENTS

WO 2001018324 3/2001

*Primary Examiner* — Ko-Wei Lin

(74) *Attorney, Agent, or Firm* — Fletcher Yoder, P.C.

(57) ABSTRACT

An exhaust fan unit of a heating, ventilation, and/or air conditioning (HVAC) system includes an outer fluid path of a nozzle assembly of the exhaust fan unit defined by and between an outer wall of the nozzle assembly and an inner wall of the nozzle assembly, an inner fluid path of the nozzle assembly defined by and radially inward from the inner wall, and a plurality of entrainment ports extending from the outer wall to the inner wall and configured to enable environmental air to pass to the inner fluid path, where each entrainment port includes a bottom surface that tapers downwardly from the inner wall to the outer wall.

20 Claims, 9 Drawing Sheets

(56) References Cited

U.S. PATENT DOCUMENTS 5,909,534 A * 6/1999 Ko ..... F24H 3/0411 392/376
6,112,850 A 9/2000 Secrest et al.
6,431,974 B1 8/2002 Tetley et al.
7,048,499 B2 5/2006 Mathson et al.
7,241,214 B2 7/2007 Sixsmith
7,320,636 B2 * 1/2008 Seliger ..... B08B 15/002 126/299 F
7,484,929 B1 2/2009 Fitzpatrick
7,682,231 B2 * 3/2010 Enzenroth ..... F04D 25/02 454/16
8,052,386 B1 11/2011 Fitzpatrick et al.
8,647,182 B2 2/2014 Enzenroth et al.
8,672,614 B1 3/2014 Fitzpatrick
8,758,101 B2 6/2014 Khalitov et al.
8,932,013 B2 1/2015 Khalitov et al.
8,974,272 B2 * 3/2015 Mornan ..... F24F 7/025 454/39
9,233,386 B2 1/2016 Mornan et al.
9,423,128 B2 8/2016 Gans et al.
9,505,092 B2 11/2016 Brownell et al.
9,636,722 B2 * 5/2017 Enzenroth ..... F23L 17/005
9,897,111 B2 * 2/2018 Mornan ..... F24F 7/025
2005/0170767 A1 * 8/2005 Enzenroth ..... B08B 15/02 454/36
2006/0014484 A1 1/2006 Seliger et al.
2006/0019592 A1 1/2006 Kupferberg et al.
2006/0019593 A1 * 1/2006 Kupferberg ..... F23L 17/005 454/16
2011/0000566 A1 * 1/2011 Ruponen ..... F24F 1/0011 138/38
2012/0292407 A1 * 11/2012 Mornan ..... F24F 13/26 239/461
2013/0011239 A1 1/2013 Khalitov et al.
2013/0193235 A1 * 8/2013 Mornan ..... F23L 17/08 239/499
2013/0283708 A1 * 10/2013 Barre ..... E04H 9/14 52/95
2013/0291735 A1 * 11/2013 Livchak ..... F24F 1/01 96/224
2014/0034039 A1 * 2/2014 Qi ..... F24C 15/20 126/299 D
2016/0040898 A1 * 2/2016 Lipinski ..... E04D 13/17 454/242
2018/0266715 A1 * 9/2018 Edmiston ..... F24F 7/02
2019/0219289 A1 * 7/2019 Sixsmith ..... F24F 7/025

* cited by examiner

EXHAUST FAN UNIT OF A HEATING, VENTILATION, AND/OR AIR CONDITIONING (HVAC) SYSTEM

CROSS-REFERENCE TO RELATED APPLICATIONS

This application claims priority from and the benefit of U.S. Provisional Application Ser. No. 62/945,621, entitled "EXHAUST FAN UNIT OF A HEATING, VENTILATION, AND/OR AIR CONDITIONING (HVAC) SYSTEM," filed Dec. 9, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A wide range of applications exists for HVAC systems. For example, residential, light commercial, commercial, and industrial systems are used to control temperatures and air quality in residences and buildings. In certain HVAC systems, exhaust gases or fumes from a space being conditioned by the HVAC system are expelled to a surrounding environment via an exhaust fan unit, sometimes referred to as a laboratory exhaust unit. It is now recognized that traditional exhaust fan units may be inefficient in removing, diluting, and dispersing exhaust gas, and may be susceptible to environmental and other damage. For example, traditional exhaust fan units may not provide adequate protection against gas leakage, flow control, dilution of contaminants, and evacuation to reduce entrainment through other HVAC intake systems or direct contact. Furthermore, traditional exhaust systems may deposit contents of the exhaust gas in small, concentrated areas of the surrounding environment.

SUMMARY

A summary of certain embodiments disclosed herein is set forth below. It should be understood that these aspects are presented merely to provide the reader with a brief summary of these certain embodiments and that these aspects are not intended to limit the scope of the disclosure. Indeed, this disclosure may encompass a variety of aspects that may be set forth below.

The present disclosure relates to an exhaust fan unit of a heating, ventilation, and/or air conditioning (HVAC) system. The exhaust fan unit includes an outer fluid path of a nozzle assembly of the exhaust fan unit defined by and between an outer wall of the nozzle assembly and an inner wall of the nozzle assembly. The exhaust fan unit also includes an inner fluid path of the nozzle assembly defined by and radially inward from the inner wall. The exhaust fan unit also includes multiple entrainment ports extending from the outer wall to the inner wall and configured to enable environmental air to pass to the inner fluid path. Each entrainment port includes a bottom surface that tapers downwardly from the inner wall to the outer wall.

The present disclosure also relates to an exhaust fan unit including an outer fluid path of a nozzle assembly of the exhaust fan unit defined by and between an outer wall of the nozzle assembly and an inner wall of the nozzle assembly. The exhaust fan unit also includes an inner fluid path of the nozzle assembly defined by and radially inward from the inner wall. The exhaust fan unit also includes a bottom surface extending radially across the inner fluid path and configured to collect liquids within the inner fluid path. The exhaust fan unit also includes entrainment ports extending from the outer wall to the inner wall and configured to enable environmental air to pass to the inner fluid path. The entrainment ports are configured to drain from the inner fluid path the liquids collected within the inner fluid path.

The present disclosure also relates to an exhaust fan unit having an outer fluid path of a nozzle assembly of the exhaust fan unit defined by and between an outer wall of the nozzle assembly and an inner wall of the nozzle assembly. The exhaust fan unit also includes an inner fluid path defined by and radially inward from the inner wall. The exhaust fan unit also includes dual-tapered shaped entrainment ports extending from the outer wall to the inner wall and configured to enable environmental air to pass to the inner fluid path.

DETAILED DESCRIPTION

Figure 1:
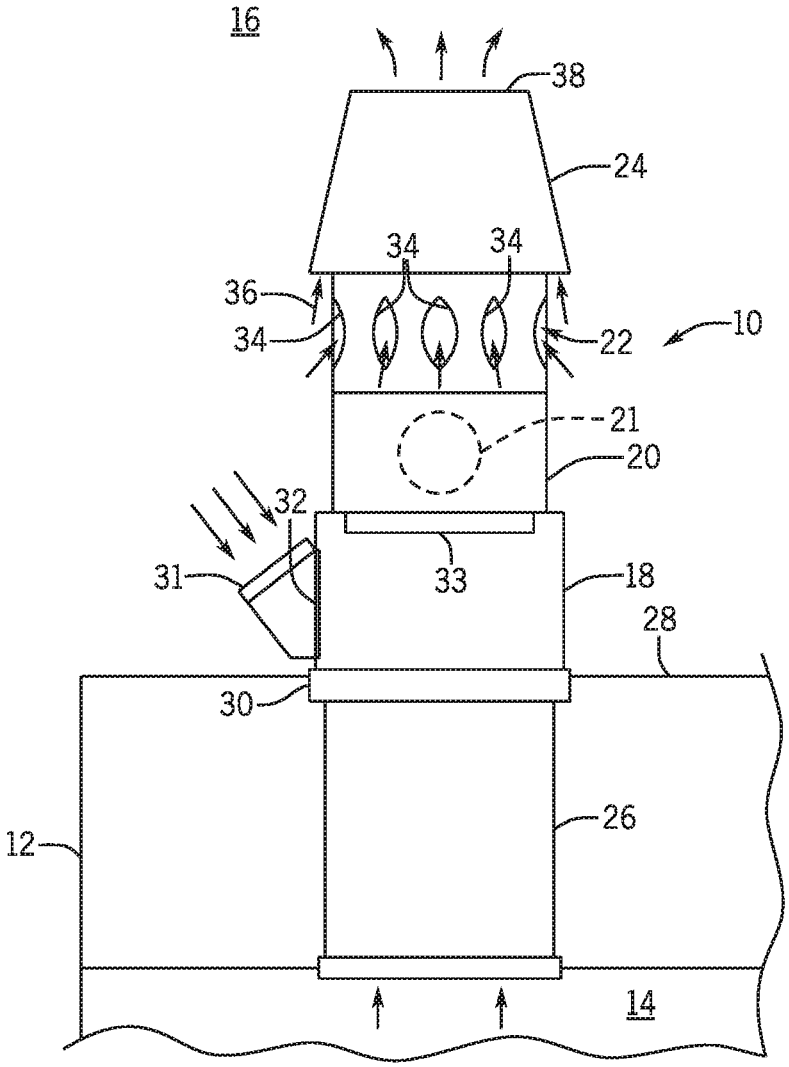
FIG. 1 is a schematic front view of an exhaust fan unit for a building, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed toward heating, ventilation, and/or air conditioning (HVAC) systems and, more particularly, toward an induction scheme of an exhaust fan unit.

In accordance with present embodiments, an exhaust fan unit includes a mixing box, a fan assembly, a nozzle assembly, and a wind band. The mixing box may be configured to receive exhaust fumes from an internal space of a building. In some embodiments, the mixing box may also receive external air from a surrounding environment, drawn into the mixing box via the fan assembly of the exhaust fan unit, via a Venturi effect, or both. In conditions where the mixing box receives the external air, the mixing box may mix the exhaust fumes from the internal space and the external air from the external environment. In other embodiments or operating modes, the mixing box may only receive the exhaust air from the internal space.

The fan assembly may cause the exhaust air or the mixture of exhaust air and external air to pass to the nozzle assembly of the exhaust fan unit. The nozzle assembly may include an outer flow path, such as an annulus, defined between an outer wall of the nozzle assembly and an inner wall of the nozzle assembly, where the annulus is configured to receive the exhaust air or the mixture of exhaust air passed thereto from the mixing box (e.g., by way of the fan assembly). The nozzle assembly may also include an inner cavity (or flow path) radially inward from the inner wall of the nozzle assembly. That is, the inner cavity may be fluidly separated from the annulus by the inner wall of the nozzle assembly. Entrainment points may be positioned about the nozzle assembly, extending between the outer wall and the inner wall forming the annulus, fluidly separate from the annulus defined between the inner and outer walls of the nozzle assembly. Thus, the entrainment ports may fluidly couple the inner cavity of the nozzle assembly and an external environment surrounding the nozzle assembly, while maintaining fluid separation from the annulus of the nozzle assembly. As the exhaust air or the mixed air exits a top end of the annulus of the nozzle assembly, a flow of the exhaust air or the mixed air may cause a pressure drop in the inner cavity of the nozzle assembly. The pressure drop may cause external air, referred to herein as nozzle entrained air, to pass through the entrainment ports, into the inner cavity of the nozzle assembly, and upwardly through a top end of the inner cavity. The top end of the annulus and the top end of the inner cavity may be disposed at similar axial levels at an exit end of the nozzle assembly.

A wind band may be attached to the nozzle assembly near the exit end of the nozzle assembly. The wind band may extend circumferentially or otherwise about the exit end of the nozzle assembly. As the exhaust air or the mixed air passes through the top end of the annulus of the nozzle assembly and as the nozzle entrained air passes through the top end of the inner cavity of the nozzle assembly, a flow thereof may cause a pressure drop adjacent a gap between the wind band and the nozzle assembly. The pressure drop may cause external air, referred to herein as wind band entrained air, to pass through the gap between the wind band and the nozzle assembly. The exhaust air or mixed air, the nozzle entrained air, and the wind band entrained air may mix radially inward from the wind band and then be ejected from an upper end of the wind band and into the external environment.

In accordance with present embodiments, the inner wall of the nozzle assembly, described above as defining the inner cavity of the nozzle assembly, may include a frustoconical shape, which is herein defined to include a true frustoconical shape or a shape similar to a frustoconical shape. That is, the inner surface of the inner wall of the nozzle assembly may flare, slope, or taper outwardly from an entry side of the nozzle assembly toward the exit side of the nozzle assembly. The frustoconical shape may be defined by a diameter that increases non-linearly, meaning that the diameter of the inner wall of the nozzle may increase non-linearly along an axial direction of the nozzle assembly, from a bottom of the frustoconical shape (i.e., the entry side of the nozzle assembly) upwardly. The outer wall of the nozzle assembly may include a cylindrical shape. One or both of these shapes may contribute to improved air flow performance of the exhaust fan unit. For example, a flow path of the outer flow path (e.g., annulus) defined between the inner wall and the outer wall of the nozzle assembly may include a restricted cross-sectional area, which enables a pressure drop that causes acceleration of the fluid flow through the annulus.

Further, the frustoconical shape may include a bottom or lower surface (e.g. lower horizontal surface) defining a floor of the inner cavity. The floor defining the inner cavity, and a shape of the entrainment ports of the nozzle assembly, may contribute to improved rain/liquid drainage from the nozzle assembly, which improves air flow performance and protects electronic components, such as fan assembly components and/or damper components, from rain damage. For example, the entrainment ports of the nozzle assembly may include a tapered shape (e.g., a tear-drop or leaf shape) that includes a tapered bottom surface sloping downwardly from the inner surface of the nozzle assembly to the outer surface of the nozzle assembly, thereby enabling rain collected on the horizontal floor to drain through the entrainment ports and into the external environment. It should be noted that the floor of the inner cavity may be flat or curbed. For example, the floor may form a bowl shape. These and other features will be described in detail below.

Turning now to the drawings, FIG. 1 is a schematic front view of an embodiment of an exhaust fan unit 10, referred to in some instances as a laboratory exhaust unit, for a building 12. In the illustrated embodiment, the building 12 includes an internal space 14 from which the exhaust fan unit 10 expels exhaust gases toward an external environment 16 surrounding the exhaust fan unit 10 and the building 12.

The exhaust fan unit 10 includes a mixing box 18, a fan assembly 20, a nozzle assembly 22, and a wind band 24. The mixing box 18 may couple to a vent or vent system 26 extending from the internal space 14 of the building 12 toward a roof 28 of the building 12. In some embodiments, a damper 30 may be positioned between the mixing box 18 and the vent system 26, where the damper 30 is configured to open and close to enable and disable, respectively, a flow of exhaust gas to the mixing box 18. The damper 30 may also include intermediate settings that enable a certain pre-determined amount of flow therethrough. The damper 30 may be a part of the exhaust fan unit 10, or a separate component from the exhaust fan unit 10 (e.g., a part of the roof 28 or building 12 and interfaced with the exhaust fan unit 10).

The mixing box 18 also includes an outdoor air inlet 31 (e.g., hood or louver) and a damper 32 (e.g., "bypass damper") configured to be opened and closed to enable a flow of outdoor air through the outdoor air inlet 31 and into the mixing box 18. The damper 32 may include intermediate settings that enable a certain pre-determined amount of flow therethrough under certain conditions. As shown, the damper 32 may be positioned within the mixing box 18 downstream from the outdoor air inlet 31 (e.g., hood or louver). An additional damper 33 may be disposed between the mixing box 18 and the fan assembly 20, and may be utilized to control a flow of fluid (e.g., air, exhaust gas or a mixed fluid of exhaust gas and air drawn into the mixing box 18 via the outdoor air inlet 31) from the mixing box 18 to the fan assembly 20.

The fan assembly 20, which sits above the mixing box 18 in the illustrated embodiment, may include an outer shell, such as a cylindrical outer shell, and a fan 21 disposed in the outer shell, where the fan 21 is configured to draw the flow of exhaust gases from the vent system 26 into the mixing box 18, and the flow of outdoor air through the outdoor air inlet 31 and into the mixing box 18. In some embodiments, the fan 21 may extend between the fan assembly 20 and the mixing box 18 (e.g., the fan 21 may extend partially into the mixing box 18). In certain operating conditions, the damper 32 may be closed to disable a flow of outdoor air through the outdoor air inlet 31, in which case only the exhaust gas is drawn into the mixing box 18. In other operating conditions, the damper 32 may be opened to enable a flow of outdoor air through the outdoor air inlet 31, and the outdoor air may be mixed with the exhaust gas in the mixing box 18. A combination of exhaust gas and outdoor air may be referred to herein as a "mixed fluid." While other dampers may also be incorporated into the mixing box 18, such dampers will be described in detail with reference to later drawings.

The fan assembly 20 may pass the exhaust gas or the mixed fluid from the fan mixing box 18, through the fan assembly 20, and to the nozzle assembly 22. The nozzle assembly 22 may include an outer wall and an inner wall, an annulus positioned radially between the outer wall and the inner wall, and an inner cavity positioned radially inward from the inner wall. The annulus may be configured to receive the exhaust gas or the mixed fluid. The annulus, inner cavity, and corresponding features (e.g., outer wall and inner wall) will be illustrated and described in detail with reference to later drawings. The nozzle assembly 22 may also include multiple entrainment ports 34 extending from the outer wall of the nozzle assembly 22 to the inner wall of the nozzle assembly 22. That is, the entrainment ports 34 may be defined by structural features of the nozzle assembly 22 extending between the outer and inner walls of the nozzle assembly 22, and the entrainment ports 34 may be fluidly coupled to the inner cavity of the nozzle assembly 22. Thus, the entrainment ports 34 may define openings that fluidly couple the inner cavity of the nozzle assembly 22 with the surrounding environment 16 around the exhaust fan unit 10. Further, the entrainment ports 34 may be fluidly separated from the annulus defined radially between the inner and outer walls of the nozzle assembly 22.

The above-described annulus of the nozzle assembly may be fluidly coupled with a space above the nozzle assembly 22, defined by the wind band 24. That is, the exhaust gas or mixed fluid may empty from the annulus of the nozzle assembly 22 into a flow path defined by the wind band 24. The flow of the exhaust gas into the wind band 24 may cause a pressure drop within the inner cavity of the nozzle assembly 22, and the pressure drop may cause a flow of outside air into the cavity of the nozzle assembly 22 via the entrainment ports 34. The cavity of the nozzle assembly 22 may also empty into the flow path defined by the wind band 24. Accordingly, the outside air drawn into the cavity of the nozzle assembly 22 may exit the nozzle assembly 22 and mix with the exhaust gas or mixed fluid that exits the annulus of the nozzle assembly 22 into the flow path defined by the wind band 24.

Additionally, an entrainment gap 36 may be defined between an inner surface of the wind band 24 and the outer surface of the nozzle assembly 22. The entrainment gap 36 may operate to fluidly couple the external environment 16 with the flow path defined inside the wind band 24. Accordingly, additional outside air may be drawn into the flow path defined inside the wind band 24 via the entrainment gap 36. The additional outside air may mix with the exhaust gas or mixed fluid, and the entrained air introduced via the entrainment ports 34 as described above. An outlet 38 of the wind band 24 may enable the exhaust fan unit 10 to expel the fluids passed therein and therethrough to the surrounding environment 16.

In accordance with present embodiments, the inner wall of the nozzle assembly 22, described above as defining the cavity of the nozzle assembly 22, may include a frustoconical shape. Further, the frustoconical shape may be defined by a diameter that increases non-linearly, meaning that the diameter of the inner wall of the nozzle may increase non-linearly along an axial direction of the nozzle assembly, from a bottom of the frustoconical shape upwardly, in the illustrated embodiment. The outer wall of the nozzle assembly 22 may include a cylindrical shape or prismatic shape. These shapes, individually or together, may contribute to improved air flow performance of the exhaust fan unit 10 and corresponding fan assembly 20. Further, the frustoconical shape may include a horizontal surface, such as a horizontal bottom surface, defining a floor of the inner cavity. The horizontal floor, and a shape of the above-describe entrainment ports 34 of the nozzle assembly 22, may contribute to improved rain drainage from the nozzle assembly 22, which improves air flow performance and protects electronic components, such as components of the fan assembly 20 and/or damper 30, 32 (or other damper) components, from water damage. For example, the entrainment ports 34 of the nozzle assembly 22 may include a tear-drop or leaf shape that includes a tapered bottom surface sloping downwardly from the inner surface of the nozzle assembly 22 to the outer surface of the nozzle assembly 22, thereby enabling rain collected on the horizontal floor to drain through the entrainment ports 34 and into the external environment 16. These and other features will be described in detail below.

Figure 2:
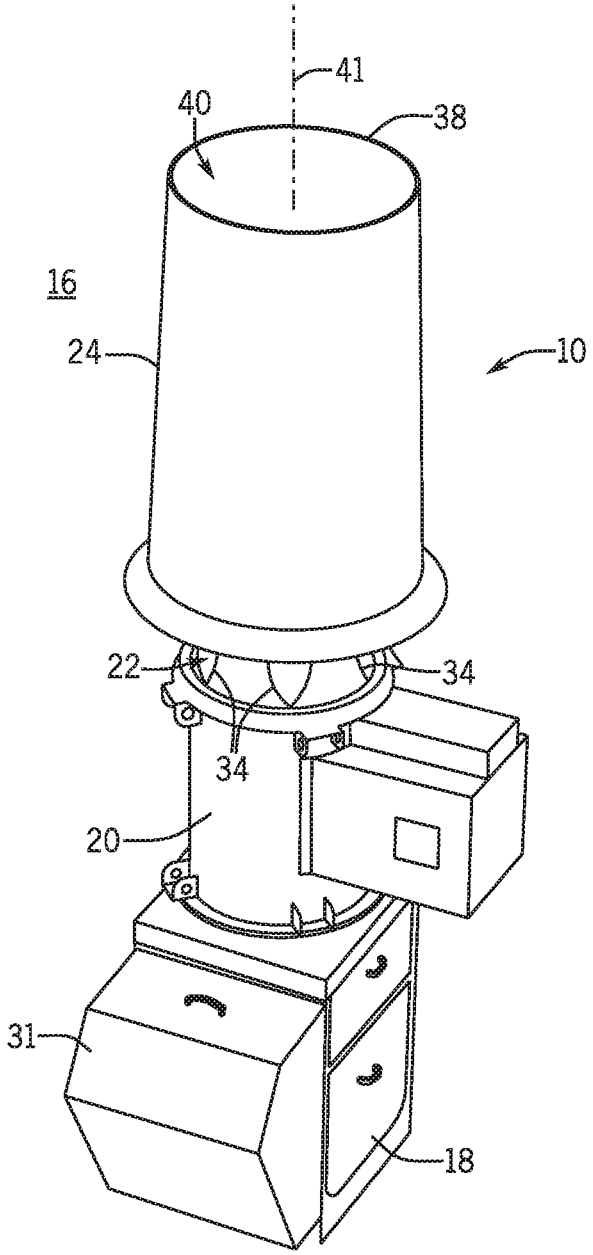
FIG. 2 is a perspective view of the exhaust fan unit of FIG. 1, in accordance with an aspect of the present disclosure.

FIG. 2 is a perspective view of an embodiment of the exhaust fan unit 10 of FIG. 1. As previously described, the exhaust fan unit 10 includes the mixing box 18 having the outdoor air inlet 31, the fan assembly 20, the nozzle assembly 22, the entrainment ports 34, and the wind band 24 including a flow path 40 and the outlet 38. A longitudinal axis 41 is illustrated in FIG. 2 extending axially from the wind band 24. In the illustrated embodiment, the wind band 24 may axially overlap with the entrainment ports 34 along the longitudinal axis 41. In other embodiments, the wind band 24 may not axially overlap with the entrainment ports 34 along the longitudinal axis 41.

Figure 3:
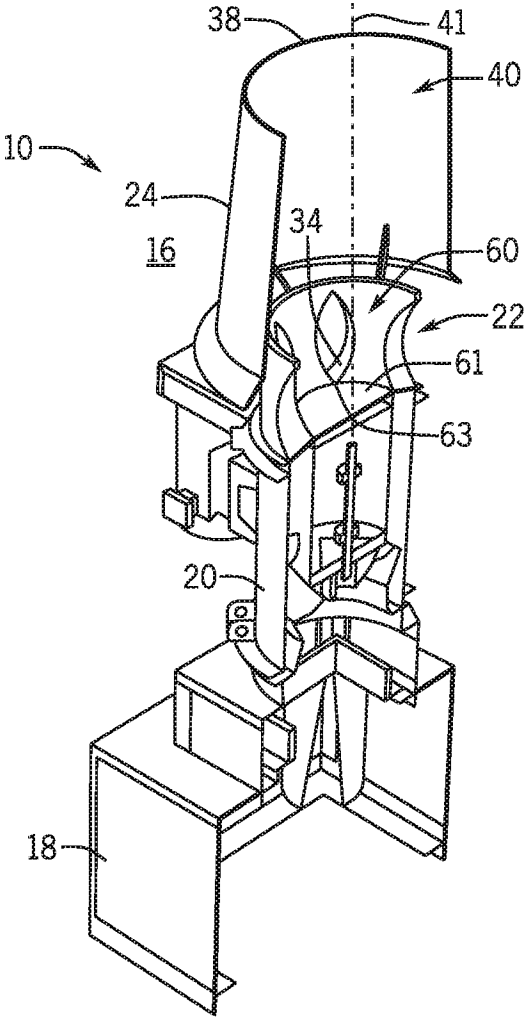
FIG. 3 is a cross-sectional perspective view of portions of the exhaust fan unit of FIG. 2, in accordance with an aspect of the present disclosure.

FIG. 3 is a perspective cross-sectional view of an embodiment of portions of the exhaust fan unit 10 of FIG. 2. As previously described, the exhaust fan unit 10 includes the mixing box 18, the fan assembly 20, the nozzle assembly 22, the entrainment ports 34 of the nozzle assembly 22, and the wind band 24 including a flow path 40 and the outlet 38. As shown in FIG. 3, the nozzle assembly 22 includes an inner cavity 60 that may be exposed to environment 16 via the entrainment ports 34 of the nozzle assembly 22. The inner cavity 60 may receive rain water or other liquids during certain conditions. A floor 61 may be included at a bottom of the inner cavity 60 to collect rain water thereon. The floor 61 may be adjacent to, or axially aligned with along the longitudinal axis 41, a bottom surface 63 (e.g., an edge) of each entrainment port 34. Thus, rain water may be drained from the floor 61 of the inner cavity 60 through the entrainment ports 34. The floor 61 may be flat or curbed (e.g., bowl shaped). Further, the bottom surface 63 (e.g., edge) of each entrainment port may slope downwardly as the bottom surface 63 (e.g., edge) moves away from the floor 61, thereby enabling rain or other water to be gravity fed out of the inner cavity 60.

Figure 4:
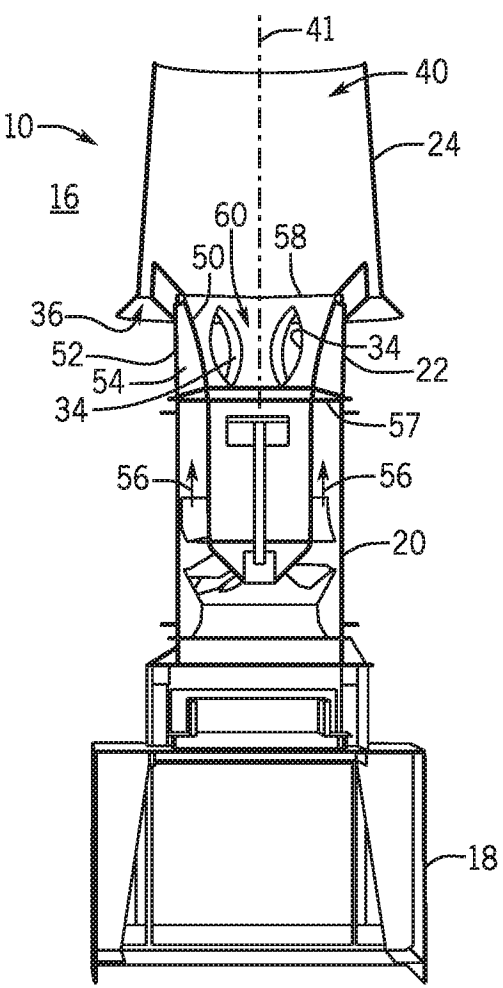
FIG. 4 is a cross-sectional front view of portions of the exhaust fan unit of FIG. 3, in accordance with an aspect of the present disclosure.

FIG. 4 is a front cross-sectional view of the portions of the exhaust fan unit of FIG. 3. Focusing on FIG. 4, the nozzle assembly 22 includes an inner wall 50, an outer wall 52, and an annulus 54 (e.g., outer flow path) defined between the inner wall 50 and the outer wall 52. As previously described, the annulus 54 may receive a flow of exhaust fumes or mixed fluid (i.e., exhaust fumes and outside air), denoted be reference numeral 56, from the fan assembly 20. The inner wall 50 of the nozzle assembly 22 may taper, curve, or slope outwardly (i.e., away from the longitudinal axis 41) toward the outer wall 52. That is, starting with an entry side 57 of the nozzle assembly 22 and moving toward an exit side 58 of the nozzle assembly 22, the inner wall 50 of the nozzle assembly 22 may taper, curve, or slope outwardly toward the outer wall 52. It should be noted that the exit side 58 is located closer to a distal end of the exhaust fan unit 10 than a base of the exhaust fan unit 10 (i.e., where the base of the exhaust fan unit 10 interfaces with the building or roof thereof).

In the illustrated embodiment, the inner wall 50 tapers outwardly non-linearly. In other embodiments, the inner wall 50 may include a linear taper. The shape of the inner surface of the inner wall 50 may form a frustoconical shape of the inner cavity 60. The shape of the outer surface of the inner wall 50 may enable a restricted cross-sectional area of the annulus 54 (i.e., inner flow path) at the exit end 58 of the nozzle assembly 22 that causes acceleration of the exhaust fumes or mixed fluid through the annulus 54 and into the flow path 40 defined by the wind band 24.

As previously described, the nozzle assembly 22 also includes the entrainment ports 34 fluidly coupling an inner cavity 60 defined radially inward from the inner wall 50 of the nozzle assembly 22. The inner cavity 60 is fluidly separate from the annulus 54 by way of the inner wall 50. As the exhaust fumes or mixed air are passed from the annulus 54 of the nozzle assembly 22 to the flow path 40 defined by the wind band 24, a pressure drop may cause environmental air to pass through the entrainment ports 34 and into the inner cavity 60. The environmental air passing through the entrainment ports 34 may be referred to as nozzle entrained air. The dual-tapered (e.g., leaf or tear-drop shape) of the entrainment ports 34 in the illustrated embodiment may improve an air flow of the nozzle entrained air therethrough. The environmental air (i.e., nozzle entrained air) may be drawn from the inner cavity 60, through the exit side 58 of the nozzle assembly 22, and into the flow path 40 defined by the wind band 24 via the above-described pressure drop. The environmental air (i.e., nozzle entrained air) may then mix with the fluid passed from the outer annulus 54 to the flow path 40 defined by the wind band 24.

The wind band 24 may also draw environmental air through a gap between the wind band 24 and the outer wall 52 of the nozzle assembly 22, referred to as the entrainment gap 36. The environmental air drawn through the entrainment gap 36 may be referred to as wind band entrained air. The wind band entrained air may mix with the nozzle entrained air and the exhaust fumes or mixed fluid passed to the flow path 40 from the nozzle assembly 22.

Figure 5:
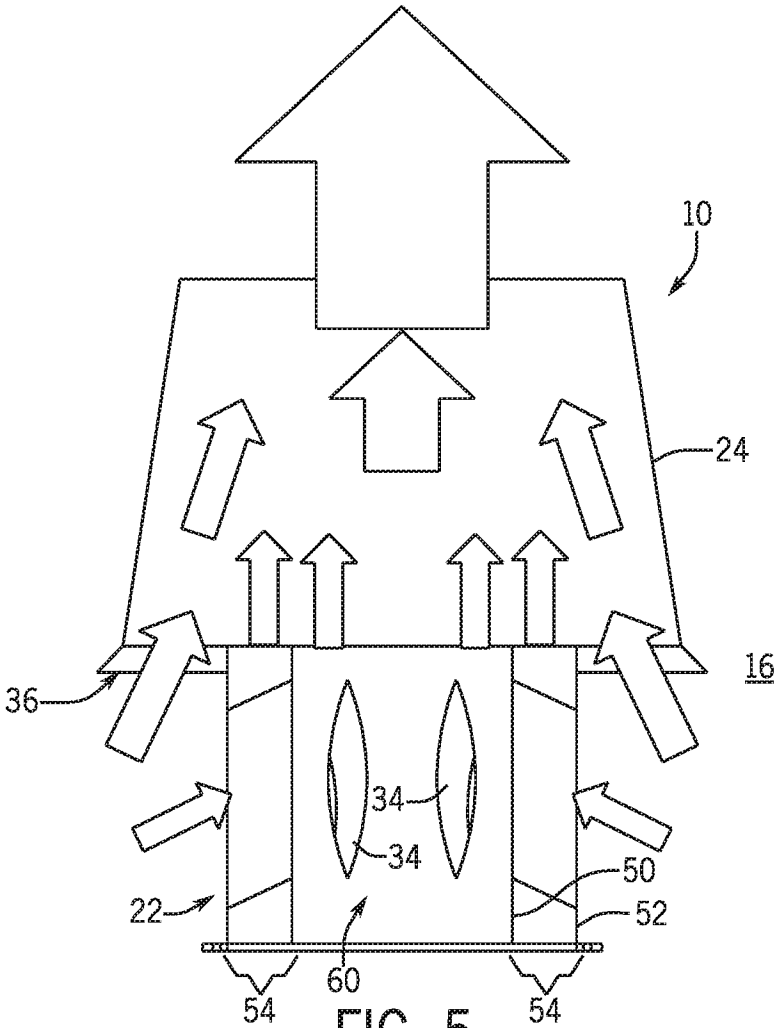
FIG. 5 is a schematic front cutaway view of a nozzle assembly and wind band for use in the exhaust fan unit of FIG. 1, in accordance with an aspect of the present disclosure.

FIG. 5 is a schematic front cutaway view of an embodiment of the nozzle assembly 22 and the wind band 24 for use in the exhaust fan unit 10 of FIG. 1. In the illustrated embodiment, the outer wall 52 of the nozzle assembly 22 is partially cutaway. FIG. 5 illustrates the fluid flow of environmental air (i.e., nozzle entrained air) through the entrainment ports 34 into the inner cavity 60, the mixed air through the annulus 54, and the environmental air (i.e., wind band entrained air) through the entrainment gap 36 defined between the wind band 24 and the nozzle assembly 22.

Figure 6:
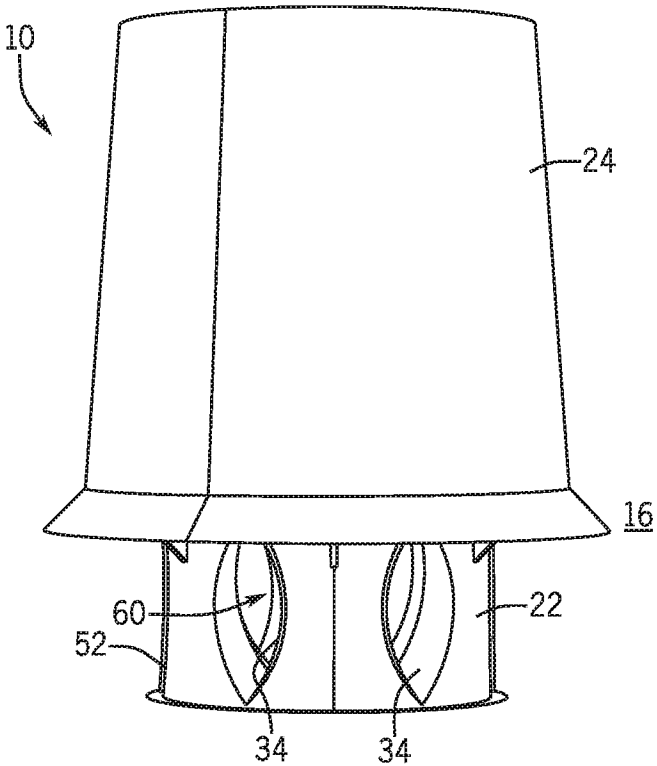
FIG. 6 is a perspective view of a nozzle assembly and wind band for use in the exhaust fan unit of FIG. 1, in accordance with an aspect of the present disclosure.
Figure 7:
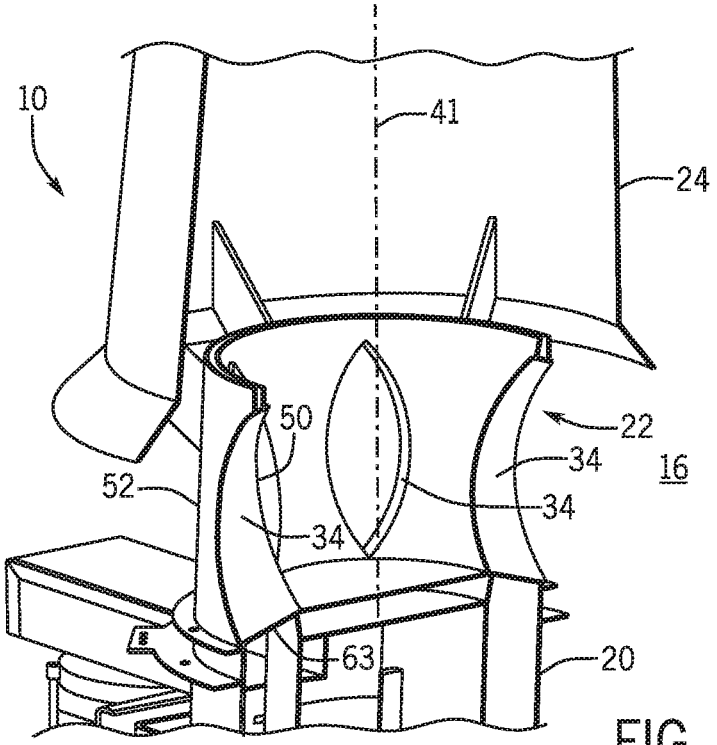
FIG. 7 is a cross-sectional perspective view of the nozzle assembly and wind band of FIG. 6, and a portion of a fan assembly, in accordance with an aspect of the present disclosure.
Figure 8:
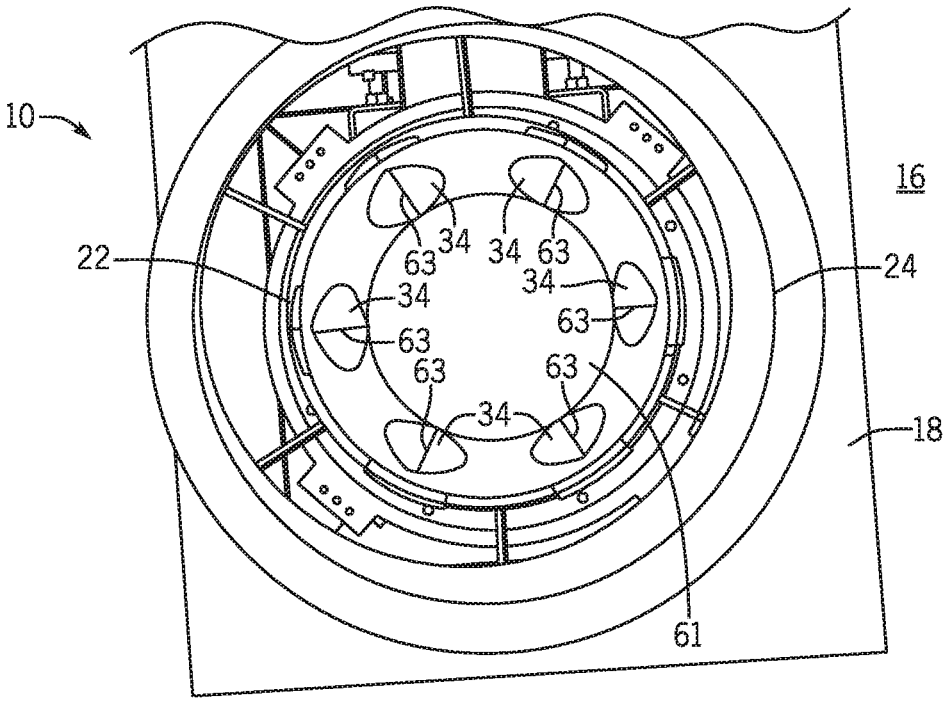
FIG. 8 is a cross-sectional top-down view of the nozzle assembly and wind band of FIG. 6, and a portion of a fan assembly, in accordance with an aspect of the present disclosure.
Figure 9:
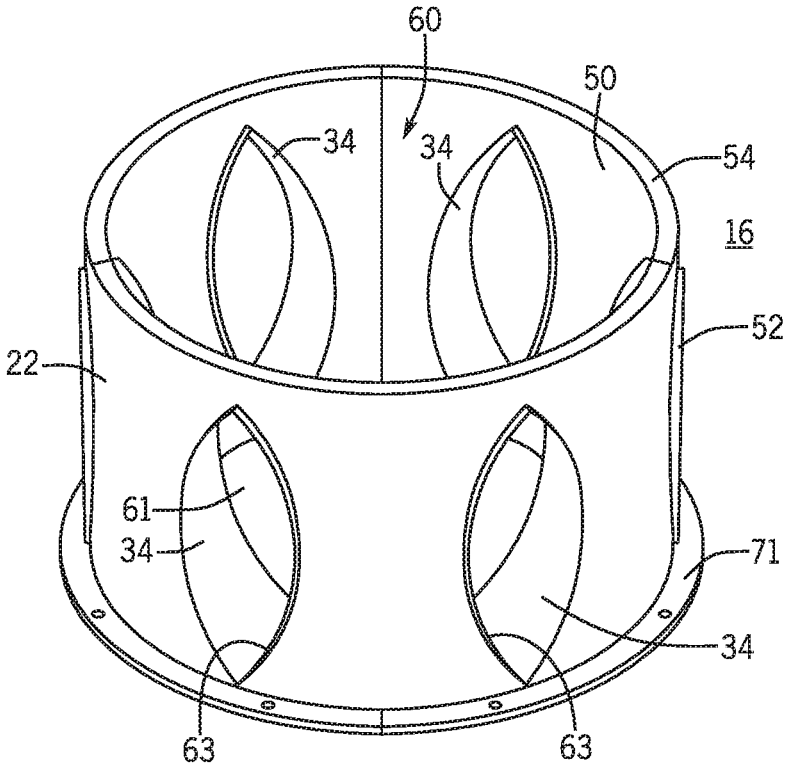
FIG. 9 is a perspective view of the nozzle assembly of FIG. 6, in accordance with an aspect of the present disclosure.
Figure 10:
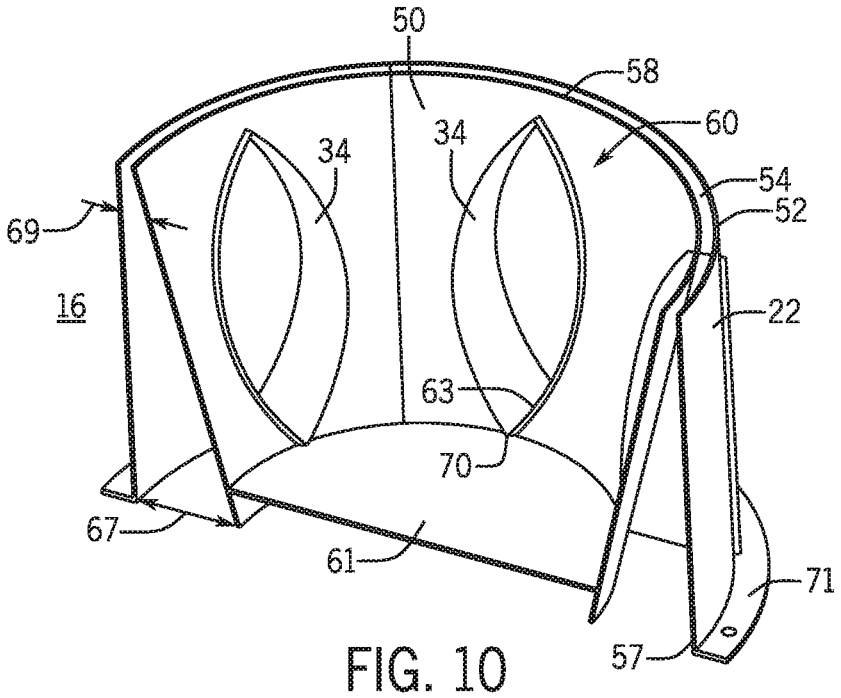
FIG. 10 is a cross-sectional perspective view of the nozzle assembly of FIG. 9, in accordance with an aspect of the present disclosure.
Figure 11:
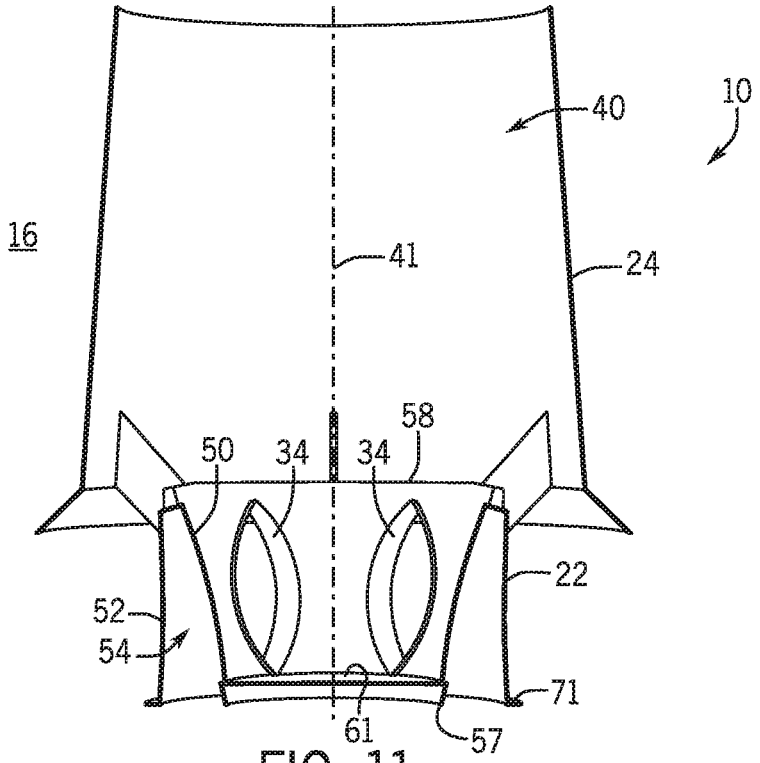
FIG. 11 is a cross-sectional front view of the nozzle assembly of FIG. 9 with a wind band attached thereto, in accordance with an aspect of the present disclosure.

FIG. 6 is a perspective view of an embodiment of the nozzle assembly 22 and the wind band 24 for use in the exhaust fan unit 10 of FIG. 1. As previously described, the entrainment ports 34 include a leaf or tear-drop shape that improves air flow performance and rain/water drainage from the inner cavity 60. The entrainment ports 34 extend from the outer wall 52 of the nozzle assembly 22 toward the inner wall of the nozzle assembly 22, and defined a flow path through which environmental air is drawn into the inner cavity 60. FIG. 7 is a cross-sectional perspective view of an embodiment of the nozzle assembly 22 and the wind band 24 of FIG. 6, and a portion of the fan assembly 20. As shown in FIG. 7, the entrainment ports 34 include sloped bottom edges 63 that slope downwardly from the inner wall 50 toward the outer wall 52 (e.g., such that the surface 63 [or edge] includes a lower point relative to the longitudinal axis 41 at the outer wall 52 than at the inner wall 50). The floor 61 may then collect rain or other water and drain the rain or other water through the entrainment ports 34. FIG. 8 is a top-down cross-sectional view of an embodiment of the nozzle assembly 22 and the wind band 24 of FIG. 6, and a portion of the fan assembly 20 and the mixing box 18. FIGS. 9, 10, and 11 illustrate the above-described entrainment ports 34 of the nozzle assembly 22. FIG. 8 also illustrates the entrainment ports 34 and the sloped bottom edges 63.

FIG. 9 is a perspective view of an embodiment of the nozzle assembly 22 of FIG. 6. FIG. 10 is a cross-sectional perspective view of an embodiment of the nozzle assembly 22 of FIG. 9. FIG. 11 is a cross-sectional front view of an embodiment of the nozzle assembly 22 and the wind band 24 of FIG. 9. FIGS. 9-11 illustrate various features of the nozzle assembly 22 in accordance with the present disclosure. For example, FIG. 9 illustrates the entrainment ports 34 having the sloped bottom surface 63 (e.g., edge) configured to drain water from the floor 61 of the nozzle assembly 22. FIG. 10 illustrates the annulus 54 defined between the outer wall 52 of the nozzle assembly 22 and the inner wall 50 of the nozzle assembly 22. The annulus 54 includes a restricted cross-sectional area toward the exit end 58 of the nozzle assembly 22, as previously described. That is, the annulus 54 includes a larger width 67 adjacent the entry end 57 of the nozzle assembly 22 than a width 69 at the exit end 58 of the nozzle assembly 22. Further, FIG. 10 illustrates a juncture 70 between the sloped bottom surface 63 (e.g., edge) of the entrainment port 34 and the floor 61 of the nozzle assembly 22. That is, in FIG. 10, the sloped bottom surface 63 (e.g., edge) extends from the floor 61 and toward the outer wall 52 of the nozzle assembly 22. In other embodiments, the floor 61 may be disposed above the sloped bottom surface 63 (e.g., edge) or below the sloped bottom surface 63 (e.g., edge). FIG. 11 illustrates the curvilinear nature of the inner wall 50 of the nozzle assembly 22. For example, in FIG. 11, the inner wall 50 includes a non-linear curvature away from the longitudinal axis 41 working from the entry end 57 of the nozzle assembly 22 toward the exit end 58 of the nozzle assembly 22. In other embodiments, the inner wall 50 may include a linear taper or may include a cylindrical surface. The illustrated curvature may improve air flow performance. In each of FIGS. 9-11, a flange 71 may extend radially outwardly from the outer wall 52 of the nozzle assembly 22, and may be configured to couple to a component (e.g., fan assembly) of the exhaust fan unit.

Figure 12:
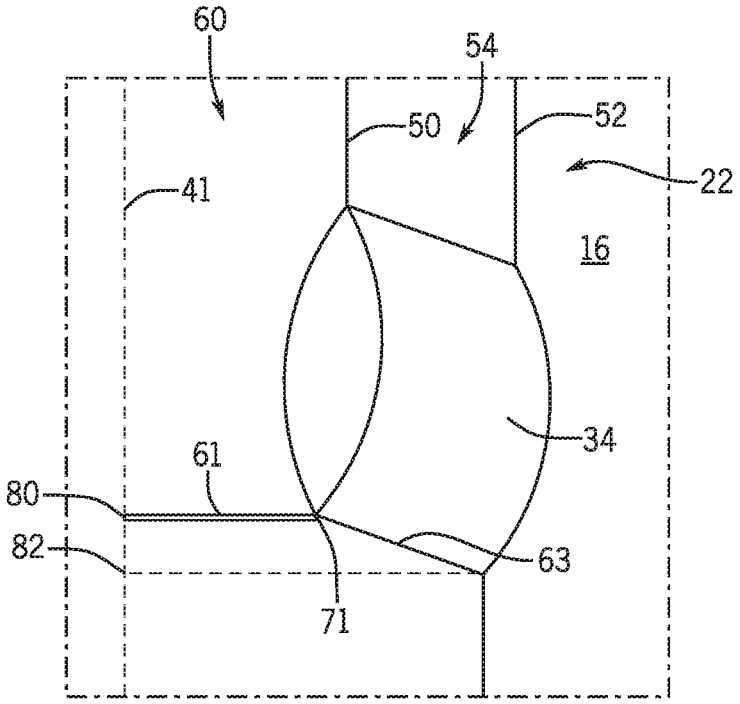
FIG. 12 is schematic view of an entrainment port for use in the exhaust fan unit of FIG. 1, in accordance with an aspect of the present disclosure.

FIG. 12 is schematic view of an embodiment of the entrainment port 34 for use in the exhaust fan unit of FIG. 1. The illustrated entrainment port 34 may be included in any of the preceding embodiments. As shown, the entrainment port may extend between the inner wall 50 of the nozzle assembly 22 and the outer wall 52 of the nozzle assembly 22. The entrainment port 34 includes a bottom surface 63 (e.g., edge) that extends from the inner wall 50 to the outer wall 52. In the illustrated embodiment, the bottom surface 63 (e.g., edge) extends from the floor 61 of the nozzle assembly 22, where the floor 61 is disposed in the inner cavity 60 defined by the inner wall 50. As previously described, the floor 61 may drain water or other liquids within the inner cavity 60 across the bottom surface 63 (e.g., edge) of the entrainment port 34 and into the environment 16. The bottom surface 63 (e.g., edge) is sloped downwardly to gravity feed the water out of the inner cavity 60. For example, as shown, the bottom surface 63 (e.g., edge) may include a higher axial position 80 adjacent the inner wall 50 than an axial position 82 of the bottom surface 63 (e.g., edge) adjacent the outer wall 52 (e.g., as measured along the longitudinal axis 41. As shown, in some embodiments, the bottom surface 63 (e.g., edge) may extend directly from the floor 61. In other embodiments, the floor 61 may include a different axial position.

Figure 13:
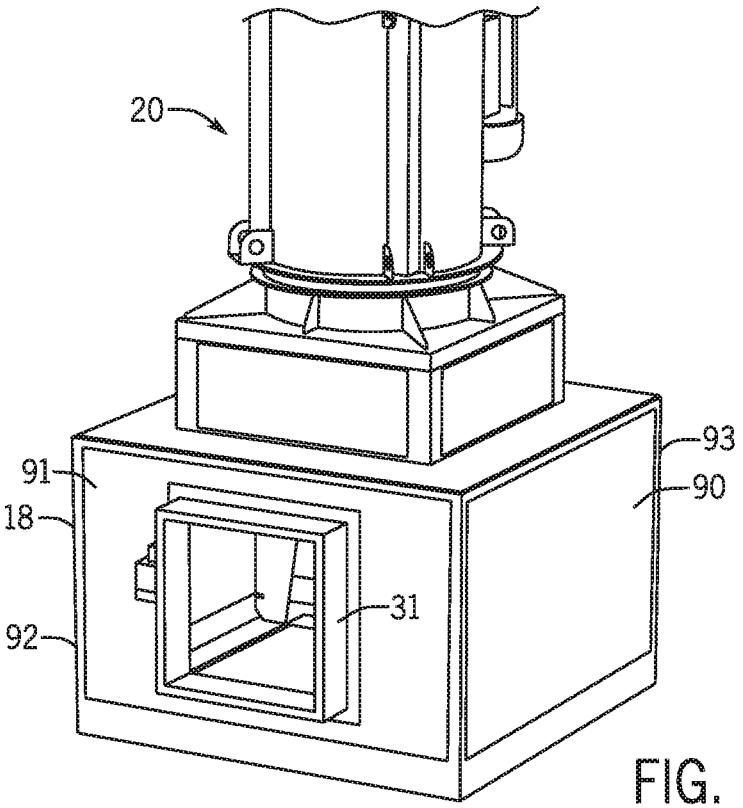
FIG. 13 is a perspective view of a fan assembly and a mixing box for use in the exhaust fan unit of FIG. 1, in accordance with an aspect of the present disclosure.
Figure 14:
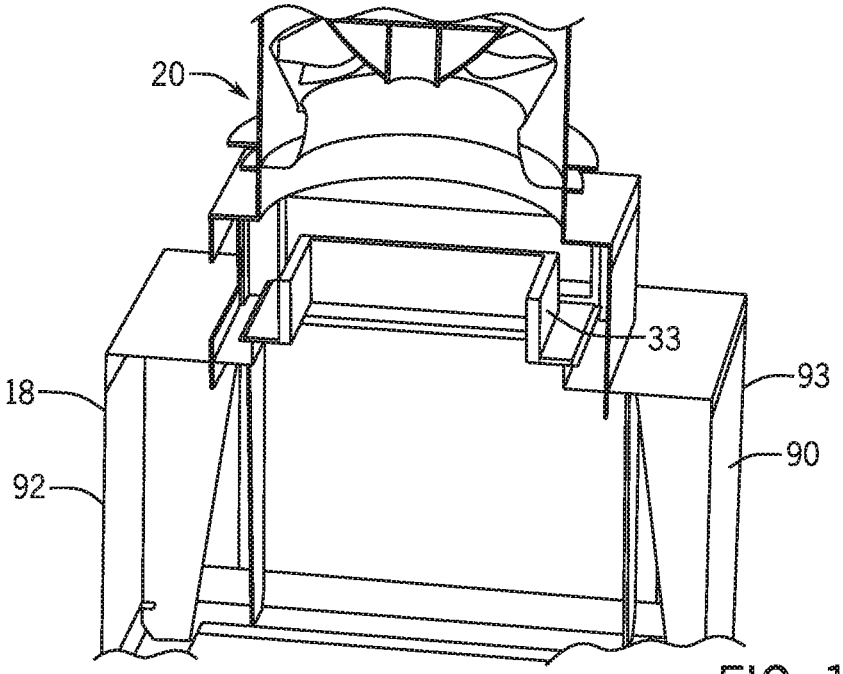
FIG. 14 is a cross-sectional perspective view of the fan assembly and the mixing box of FIG. 13, in accordance with an aspect of the present disclosure.
Figure 15:
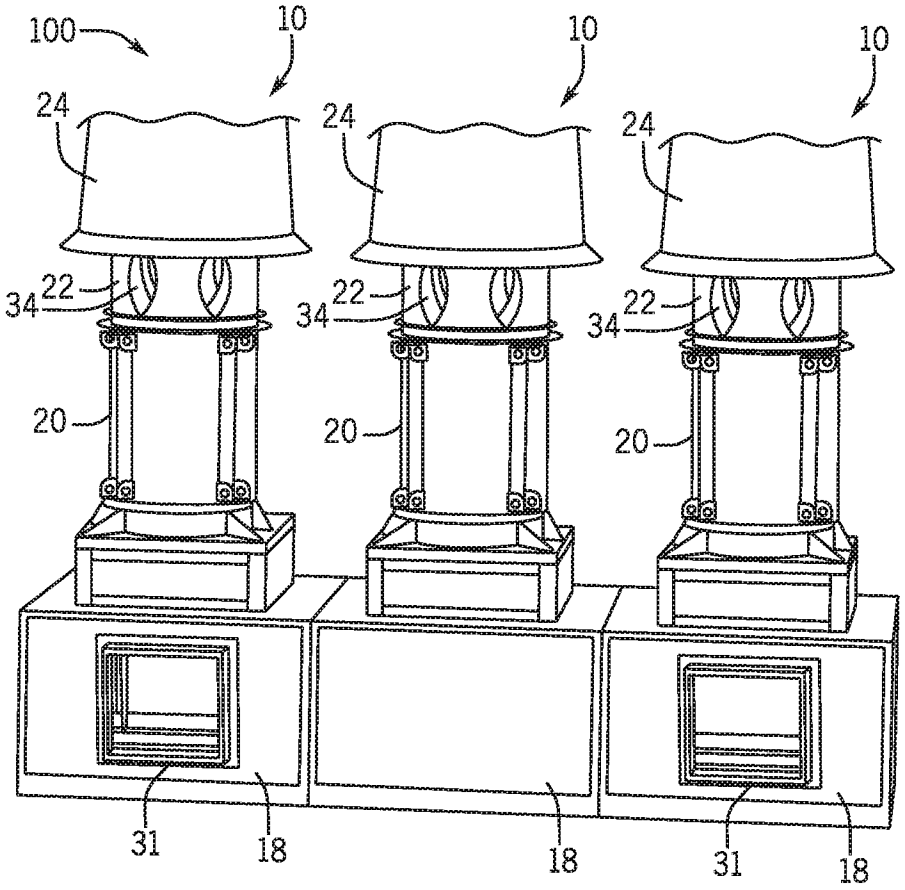
FIG. 15 is a perspective view of multiple exhaust fan units of a heating, ventilation, and/or air conditioning (HVAC) system, in accordance with an aspect of the present disclosure.

FIG. 13 is a perspective view of an embodiment of the fan assembly 20 and the mixing box 18 for use in the exhaust fan unit 10 of FIG. 1. FIG. 14 is a cross-sectional perspective view of an embodiment of the fan assembly 20 and the mixing box 18 of FIG. 13. FIG. 15 is a perspective view of an embodiment of multiple of the above-described exhaust fan units 10 arranged in a ventilation system 100. In FIG. 13, the outdoor air inlet 31 may be configured to enable outdoor air to enter the mixing box. The outdoor air inlet 31 may be equipped with a damper configured to open to enable flow of outdoor air and close to disable flow of outdoor air. In some embodiments, the damper may include intermediate settings that enable a particular amount of outdoor air flow. The mixing box 18 is shaped such that the outdoor air inlet 31 and the corresponding damper can be disposed on any of four sides 90, 91, 92, 93 of the mixing box 18. This may enable versatile integration of the exhaust fan unit in the ventilation system 100. For example, as shown in FIG. 15, the outdoor air inlets 31 of various exhaust fan units 10 may point in different directions. That is, the central exhaust fan unit 10 in the illustrated embodiment is directed away from the viewer, whereas the outer exhaust fan units 10 in the illustrated embodiment face the viewer. The versatility may improve air flow of environmental air into the various exhaust fan units 10 and improve efficiency of the system 100.

In accordance with the present disclosure, an exhaust fan unit includes a nozzle assembly having an inner wall defining a cavity radially inward from the inner wall, and an outer wall that defines a flow annulus radially between the inner wall and the outer wall. Entrainment ports may also extend between the inner wall and the outer wall, defining a flow passage fluidly separate from the flow annulus and coupling the cavity of the nozzle assembly with a surrounding environment. The inner wall of the nozzle assembly, described above as defining the inner cavity of the nozzle assembly, may include a frustoconical shape. Further, the frustoconical shape may be defined by a diameter that increases non-linearly, meaning that the diameter of the inner wall of the nozzle may increase non-linearly along an axial direction of the nozzle assembly, from a bottom of the frustoconical shape upwardly. The outer wall of the nozzle assembly may include a cylindrical shape. One or both of these shapes may contribute to improved air flow performance of the exhaust fan unit. Further, the frustoconical shape may include a horizontal surface, such as a horizontal bottom surface, defining a floor of the inner cavity. The horizontal floor defining the inner cavity, and shape of the above-describe entrainment ports of the nozzle assembly, may contribute to improved rain drainage from the nozzle assembly, which improves air flow performance and protects electronic components, such as fan assembly components and/or damper components, from rain damage. For example, the entrainment ports of the nozzle assembly may include a tear-drop or leaf shape that includes a tapered bottom surface sloping downwardly from the inner surface of the nozzle assembly to the outer surface of the nozzle assembly, thereby enabling rain collected on the horizontal floor to drain through the entrainment ports and into the external environment. These and other features of the exhaust fan unit improves air flow performance of the exhaust fan unit, distribution of exhaust gas contents, rain drainage, and electronics protection.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An exhaust fan unit of a heating, ventilation, and/or air conditioning (HVAC) system, the exhaust fan unit comprising:

an outer fluid path of a nozzle assembly of the exhaust fan unit defined by and between an outer wall of the nozzle assembly and an inner wall of the nozzle assembly;

an inner fluid path of the nozzle assembly defined by and radially inward from the inner wall;

a floor disposed at a bottom of the inner fluid path and configured to collect a liquid thereon; and a plurality of entrainment ports extending from the outer wall to the inner wall and configured to enable environmental air to pass to the inner fluid path, wherein each entrainment port comprises a bottom surface that tapers downwardly from the inner wall to the outer wall, each bottom surface being axially aligned with the floor adjacent to the inner wall and relative to a longitudinal axis of the nozzle assembly, such that each bottom surface is configured to receive the liquid collected on the floor and drain the liquid to an external environment.

2. The exhaust fan unit of claim 1, wherein the floor comprises a bowl shape.

3. The exhaust fan unit of claim 1, wherein the inner wall comprises a frustoconical shape extending, relative to the longitudinal axis of the nozzle assembly, from a first axial position underneath the floor to a second axial position above the floor, and wherein the floor is coupled to an inner surface of the inner wall at a third axial position between the first axial position and the second axial position.

4. The exhaust fan unit of claim 1, comprising a wind band attached to the outer wall.

5. The exhaust fan unit of claim 4, wherein the wind band is attached to an outer surface of the outer wall.

6. The exhaust fan unit of claim 4, wherein a wind band flow path of the wind band is configured to receive a first fluid flow from the outer fluid path of the nozzle assembly and a second fluid flow from the inner fluid path of the nozzle assembly.

7. The exhaust fan unit of claim 1, wherein each entrainment port of the plurality of entrainment ports comprises a leaf or tear-drop shape.

8. The exhaust fan unit of claim 1, wherein the inner wall comprises an outer surface tapered or curved to restrict a cross-section of the outer fluid path at an upper end of the outer fluid path.

9. The exhaust fan unit of claim 1, wherein the outer wall comprises a cylindrical shape.

10. An exhaust fan unit of a heating, ventilation, and/or air conditioning (HVAC) system, the exhaust fan unit comprising:

an outer fluid path of a nozzle assembly of the exhaust fan unit defined by and between an outer wall of the nozzle assembly and an inner wall of the nozzle assembly;

an inner fluid path of the nozzle assembly defined by and radially inward from the inner wall;

a floor extending radially across the inner fluid path and configured to collect liquids within the inner fluid path; and a plurality of entrainment ports extending from the outer wall to the inner wall and configured to enable environmental air to pass to the inner fluid path, wherein each entrainment port of the plurality of entrainment ports comprises a bottom edge that is axially aligned with the floor adjacent to the inner wall and relative to a longitudinal axis of the nozzle assembly, such that each bottom edge is configured to drain from the inner fluid path the liquids collected within the inner fluid path.

11. The exhaust fan unit of claim 10, wherein the inner wall comprises a frustoconical shape extending, relative to the longitudinal axis of the nozzle assembly, from a first axial position underneath the floor to a second axial position above the floor, and wherein the floor is coupled to an inner surface of the inner wall at a third axial position between the first axial position and the second axial position.

12. The exhaust fan unit of claim 10, comprising a wind band attached to the outer wall and configured to receive a first fluid flow from the inner fluid path and a second fluid flow the outer fluid path.

13. The exhaust fan unit of claim 12, wherein the wind band is attached to an outer surface of the outer wall of the nozzle assembly.

14. The exhaust fan unit of claim 10, wherein the inner wall comprises an outer surface tapered or curved to restrict a cross-section of the outer fluid path at an upper end of the outer fluid path.

15. The exhaust fan unit of claim 10, wherein the outer wall comprises a cylindrical shape.

16. The exhaust fan unit of claim 10, wherein each entrainment port of the plurality of entrainment ports comprises a leaf or tear-drop shape.

17. An exhaust fan unit of a heating, ventilation, and/or air conditioning (HVAC) system, the exhaust fan unit comprising:

an outer fluid path of a nozzle assembly of the exhaust fan unit defined by and between an outer wall of the nozzle assembly and an inner wall of the nozzle assembly;

an inner fluid path defined by and radially inward from the inner wall; and a plurality of dual-tapered leaf shaped entrainment ports extending from the outer wall to the inner wall and configured to enable environmental air to pass to the inner fluid path, wherein each dual-tapered leaf shaped entrainment port of the plurality of dual-tapered leaf shaped entrainment ports comprises:

a first curved surface;

a second curved surface; and a bottom edge coupling the first curved surface with the second curved surface, wherein each bottom edge is configured to receive and drain liquids from the inner fluid path to an external environment.

18. The exhaust fan unit of claim 17, wherein the bottom edge of each dual-tapered leaf shaped entrainment port of the plurality of dual-tapered leaf shaped entrainment ports tapers downwardly from the inner wall to the outer wall, and wherein the nozzle assembly comprises a floor disposed at a bottom of the inner fluid path, axially aligned with the bottom edge of each dual-tapered leaf shaped entrainment port of the plurality of dual-tapered leaf shaped entrainment ports at the inner wall and relative to a longitudinal axis of the nozzle assembly, and configured to enable the liquids to drain from the inner fluid path through the plurality of dual-tapered leaf shaped entrainment ports and to the external environment.

19. The exhaust fan unit of claim 18, wherein the inner wall comprises a frustoconical shape extending, relative to the longitudinal axis of the nozzle assembly, from a first axial position underneath the floor to a second axial position above the floor, and wherein the floor is coupled to an inner surface of the inner wall at a third axial position between the first axial position and the second axial position.

20. The exhaust fan unit of claim 17, wherein the nozzle assembly comprises a floor disposed at a bottom of the inner fluid path, wherein a portion of the bottom edge of each dual-tapered leaf shaped entrainment port of the plurality of dual-tapered leaf shaped entrainment ports is axially above the floor relative to a longitudinal axis of the nozzle assembly, and wherein the bottom edge of each dual-tapered leaf shaped entrainment port of the plurality of dual-tapered leaf shaped entrainment ports is configured to drain, from the inner fluid path, liquid collected on the floor.

* * * * *